US009725872B2

(12) United States Patent
Freitag et al.

(10) Patent No.: US 9,725,872 B2
(45) Date of Patent: Aug. 8, 2017

(54) ENCLOSING STRUCTURE AND ASSOCIATED ASSEMBLY AND DISASSEMBLY METHODS

(75) Inventors: Nicolas Freitag, Orsay (FR); Jerome Stubler, Paris (FR)

(73) Assignee: Terre Armee Internationale, Velizy Villacoublay (FR)

( * ) Notice: Subject to any disclaimer, the term of this patent is extended or adjusted under 35 U.S.C. 154(b) by 0 days.

(21) Appl. No.: 14/007,816

(22) PCT Filed: Mar. 29, 2012

(86) PCT No.: PCT/FR2012/050675

§ 371 (c)(1),
(2), (4) Date: Sep. 26, 2013

(87) PCT Pub. No.: WO2012/131270

PCT Pub. Date: Oct. 4, 2012

(65) Prior Publication Data

US 2014/0013676 A1 Jan. 16, 2014

(30) Foreign Application Priority Data

Mar. 29, 2011 (FR) ..... 11 52593

(51) Int. Cl.

| | |
|---|---|
| ***E04H 3/14*** | (2006.01) |
| ***E02D 29/05*** | (2006.01) |
| ***E04B 7/10*** | (2006.01) |
| ***E04B 7/14*** | (2006.01) |
| ***E04B 1/342*** | (2006.01) |
| ***E04B 7/08*** | (2006.01) |
| ***E04H 3/10*** | (2006.01) |
| *E04H 15/38* | (2006.01) |
| *E04H 15/20* | (2006.01) |

(52) U.S. Cl.

CPC ..... *E02D 29/05* (2013.01); *E04B 1/342* (2013.01); *E04B 7/08* (2013.01); *E04B 7/105* (2013.01); *E04B 7/14* (2013.01); *E04H 3/10* (2013.01); *E04H 3/14* (2013.01); *E04H 15/38* (2013.01); *E04H 2015/203* (2013.01)

(58) Field of Classification Search

CPC ..... E04H 15/38; E04H 3/14; E04H 2015/203; E04H 3/10; E04B 7/166; E04B 7/163; E04B 7/14; E04B 7/105; E04B 7/08; E04B 1/342; E02D 29/05

USPC ..... 52/6, 66, 3, 4, 23, 169.1, 80.2, 745.15, 52/746.11, 155, 166, DIG. 11

See application file for complete search history.

(56) References Cited

U.S. PATENT DOCUMENTS

| | | | | | |
|---|---|---|---|---|---|
| 777,441 | A | * | 12/1904 | Small | 52/23 |
| 2,692,566 | A | * | 10/1954 | Mitchell | 52/63 |
| 3,115,226 | A | * | 12/1963 | Thompson, Jr. | 52/98 |
| 3,138,828 | A | * | 6/1964 | Greenbie | 52/93.1 |
| 3,242,623 | A | * | 3/1966 | Brisse | 52/155 |
| 3,736,754 | A | * | 6/1973 | Azalbert et al. | 405/53 |
| 3,744,191 | A | * | 7/1973 | Bird | 52/2.23 |

(Continued)

FOREIGN PATENT DOCUMENTS

| | | | |
|---|---|---|---|
| DE | 2508935 | A | * 10/1975 |
| GB | 1363409 | A | * 8/1974 |
| JP | 07293046 | A | * 11/1995 |

*Primary Examiner* — Babajide Demuren
(74) *Attorney, Agent, or Firm* — Dentons US LLP

(57) ABSTRACT

An enclosing structure (1) comprising a backfill (2) and a roof (3), wherein the roof rests on the backfill and is attached to it.

15 Claims, 5 Drawing Sheets

(56) References Cited

U.S. PATENT DOCUMENTS

Figure 1:
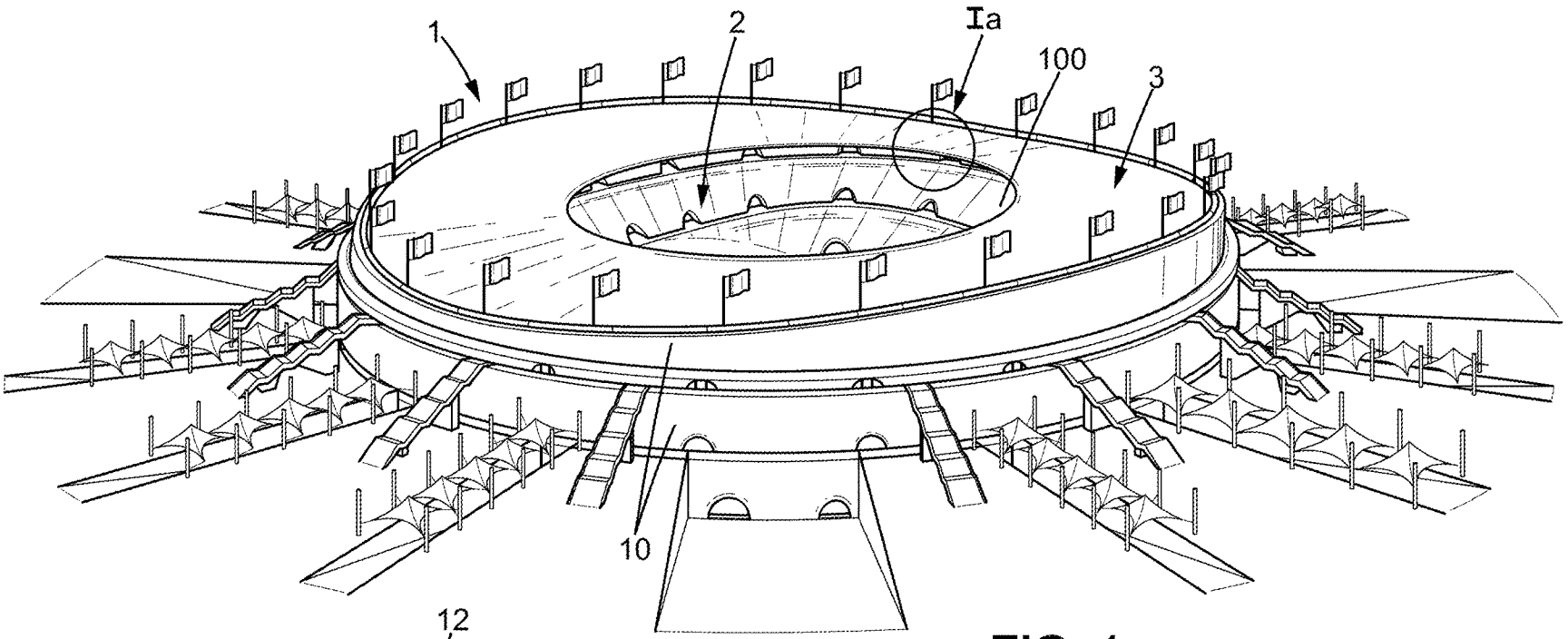

| | | | | | |
|---|---|---|---|---|---|
| 3,772,836 | A | * | 11/1973 | Geiger | 52/81.2 |
| 3,835,599 | A | | 9/1974 | Geiger | |
| 3,949,527 | A | * | 4/1976 | Double et al. | 52/4 |
| 4,452,017 | A | * | 6/1984 | Tang et al. | 52/2.17 |
| 4,831,792 | A | * | 5/1989 | Berger | 52/66 |
| 4,858,397 | A | * | 8/1989 | Lantz | 52/80.2 |
| 5,319,896 | A | * | 6/1994 | Winger | 52/23 |
| 5,384,993 | A | * | 1/1995 | Phillips | 52/92.2 |
| 5,522,184 | A | * | 6/1996 | Oviedo-Reyes | 52/23 |
| 5,531,547 | A | * | 7/1996 | Shimada | 405/262 |
| 5,579,794 | A | * | 12/1996 | Sporta | 135/88.01 |
| 5,687,512 | A | * | 11/1997 | Spoozak et al. | 52/23 |
| 5,791,090 | A | * | 8/1998 | Gitlin et al. | 52/4 |
| 5,819,477 | A | * | 10/1998 | Gaffney | 52/23 |
| 6,003,269 | A | * | 12/1999 | McRee | 52/6 |
| 6,282,842 | B1 | * | 9/2001 | Simens | 52/2.11 |
| 7,726,078 | B2 | * | 6/2010 | Kolozsvary-Kiss | 52/86 |
| 2004/0109729 | A1 | * | 6/2004 | Hilfiker et al. | 405/262 |
| 2005/0102926 | A1 | * | 5/2005 | Carte et al. | 52/157 |
| 2006/0153646 | A1 | * | 7/2006 | Cammack | 405/285 |
| 2007/0000183 | A1 | * | 1/2007 | Logan | 52/3 |
| 2007/0094937 | A1 | * | 5/2007 | Pedretti | 52/2.11 |

* cited by examiner

ENCLOSING STRUCTURE AND ASSOCIATED ASSEMBLY AND DISASSEMBLY METHODS

This Application is a 35 U.S.C. §371 National Stage Entry of International Application No. PCT/FR2012/050675, filed Mar. 29, 2012 and claims the benefit of French Application No. 11 52593, filed Mar. 29, 2011, all of which are incorporated by reference in their entirety herein.

This invention relates to an enclosing structure, meaning a civil engineering work that is substantially circular or more generally annular in its general shape (i.e. any closed geometric shape, for example elliptical, square, rectangular, polygonal, etc.). For example, such an enclosing structure may correspond in whole or in part to a stadium, an arena, or some other structure.

Various enclosing structures are known that comprise a structural element topped by a roof, such as a sports stadium at least partially covered by roof. In such a stadium, the vertical force exerted by the weight of the roof is distributed into the stands (i.e. benches). These stands, and in general the structural elements conventionally used, are made of concrete or similar compact and solid materials.

Structural elements using such materials have several disadvantages, including their high cost, their lack of portability, and the difficulty in dismantling and/or reusing them.

This invention improves the situation by proposing an enclosing structure comprising a backfill (i.e. an embankment) and a roof, wherein the roof rests on the backfill and is attached to it.

The use of a backfill, instead of a conventional structural element made of concrete for example, reduces the cost of creating such an enclosing structure and also increases portability and the ability to dismantle and/or reuse it at another location.

The backfill consists of soil, earth, granular material such as crushed rock possibly stabilized with a hydraulic binder, artificial material such as crushed concrete, industrial waste, and/or other material. By its very nature its structure is granular to a greater or lesser extent, which distinguishes it from the materials used for structural elements of the prior art.

Advantageously, the backfill can be reinforced by at least one reinforcement situated at least partially inside the backfill. This gives the structure better stability.

Advantageously, at least one reinforcement used to reinforce the backfill can be connected to a facing defining an outside boundary for the backfill.

One will note that if a relatively light roof is used, such as a flexible sheet stretched above the structural element, it may be temporarily or continuously subjected to an uplift phenomenon. This phenomenon typically results from forces with an upward vertical component. Thus the dynamic effects of an earthquake or simply of wind circulating inside a stadium and/or the constant stress resulting from using a particular form for the roof all represent non-limiting examples of such forces.

If not completely compensated for by the weight of the roof, the uplift phenomenon may cause an upward displacement of at least a portion of the roof. This displacement may in turn cause damage to the structure and/or its surroundings.

To limit this uplift phenomenon, the roof can advantageously be attached to the backfill by means of anchoring systems which each comprise an anchoring element positioned inside a lower portion of the backfill or immediately under a bottom face of the backfill and at least one tie connecting the anchoring element and the roof through the backfill.

The use of anchoring systems allows the roof to be firmly attached to the backfill, and thus limits the risk of roof uplift. In addition, these anchoring systems are well suited for enclosing structures comprising a backfill as a structural element, given that the substantial mass of the backfill provides significant weight which impedes any upward movement of the anchoring elements, and therefore of the roof because of the ties.

In other advantageous embodiments, which can be combined with each other and/or with the above characteristics in any conceivable manner:

- said tie of each anchoring system is encased in a sheath to prevent direct contact between said tie and the backfill. This limits friction as well as possible deterioration of the tie;
- said tie, through the backfill, of each anchoring system is prestressed between the anchoring element and the roof;
- the roof is placed on a capping beam atop the backfill;
- the roof comprises at least one sheet extending from a peripheral compression ring with the aid of at least one network of cables which includes taut spokes substantially perpendicular to the compression ring;
- the compression ring sits on the capping beam or directly on the backfill;
- the capping beam and/or the compression ring is weighted inside and/or at top in a manner that creates or reinforces the uplift resistance of the roof;
- the compression ring is arranged to deform radially and a mobile connecting means is placed between the compression ring and the backfill to allow a relative displacement as such radial deformation occurs. This limits the horizontal stresses passed on to the capping beam or the backfill;
- the roof comprises two sheets arranged in the shape of a lens, and the two sheets are connected to each other by means of bracings substantially orthogonal to a plane containing the compression ring;
- said sheet extends in a shape substantially consisting of two upper opposing parts and two lower opposing parts (the concepts of "upper" and "lower" are relative here), such as a hyperboloid shape, from a peripheral compression ring adapted to said shape, with the aid of a single network of cables which includes taut spokes substantially perpendicular to the compression ring; and/or
- the enclosing structure consists in at least part of a stadium or an arena.

The invention also proposes a method for assembling an enclosing structure as described above. This assembly method comprises the following steps:

- providing anchoring elements;
- alternately superimposing tie segments and backfill layers, such that a lower segment of each tie is connected to an anchoring element positioned inside a lower portion of the backfill or immediately under a bottom face of the backfill, and an upper segment of each tie extends beyond an upper portion of the backfill;
- installing a roof such that said roof rests on the backfill and is attached to the backfill with the aid of the upper segment of each tie.

The invention also proposes a method for disassembling an enclosing structure comprising a backfill and a roof, as mentioned above. This disassembly method comprises the following steps:

separating the roof from the ties connecting it to the anchoring elements positioned inside a lower portion of the backfill or immediately under a bottom face of the backfill;

taking down the roof;

alternately extracting segments of said ties and layers of backfill;

extracting the anchoring elements.

Figure 1A:
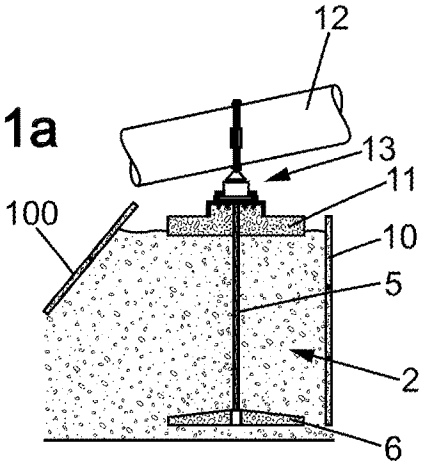
Figure 2:
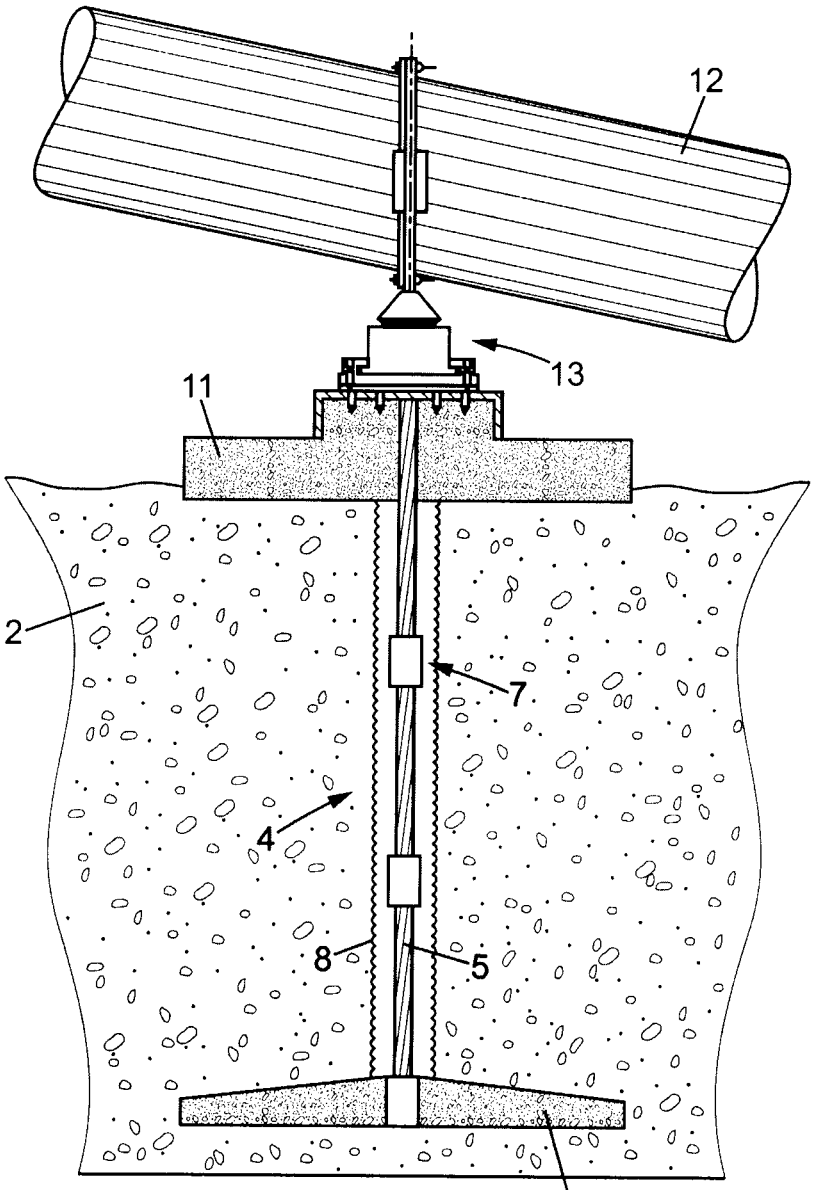
Figure 3:
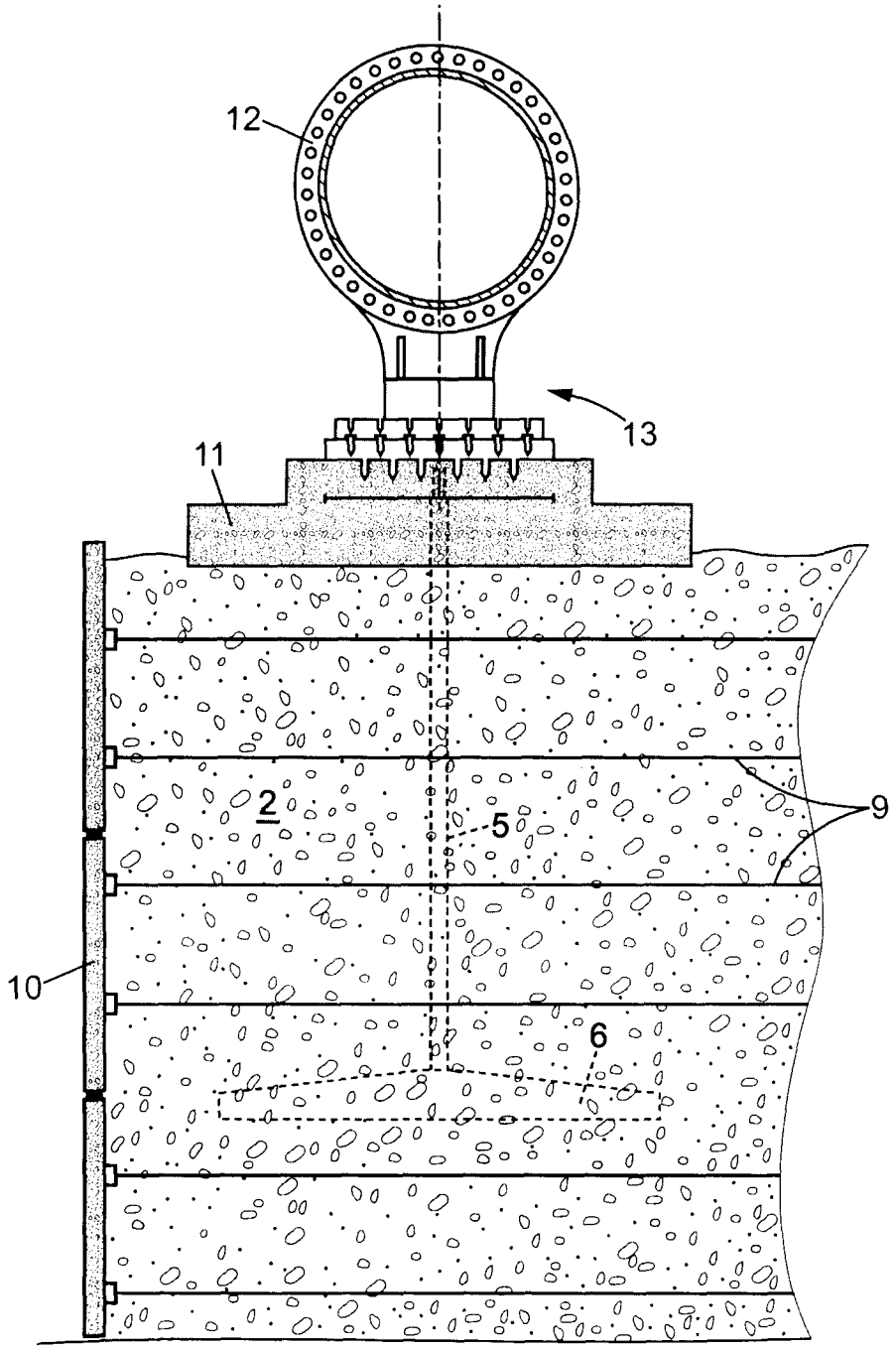
Figure 4A:
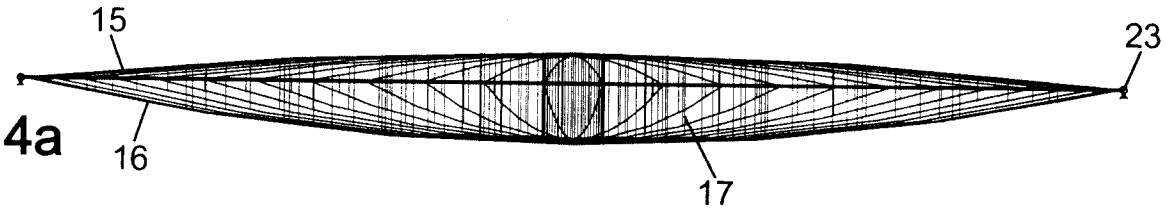
Figure 4B:
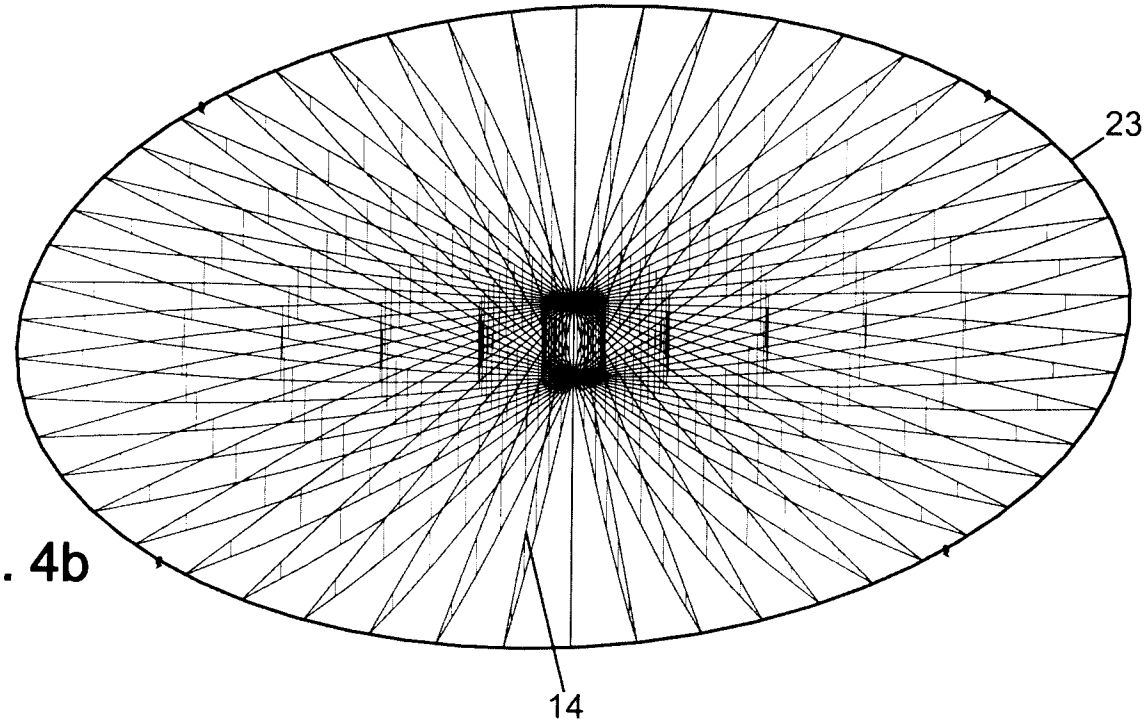
Figure 5A:
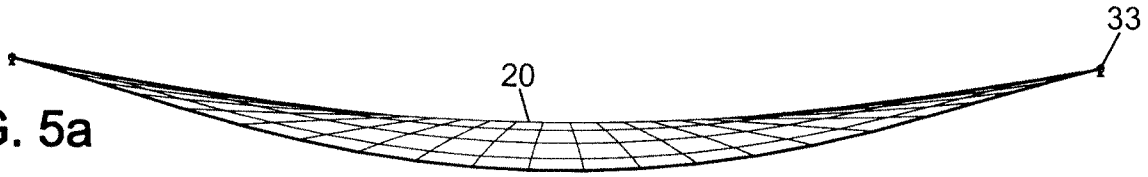
Figure 5B:
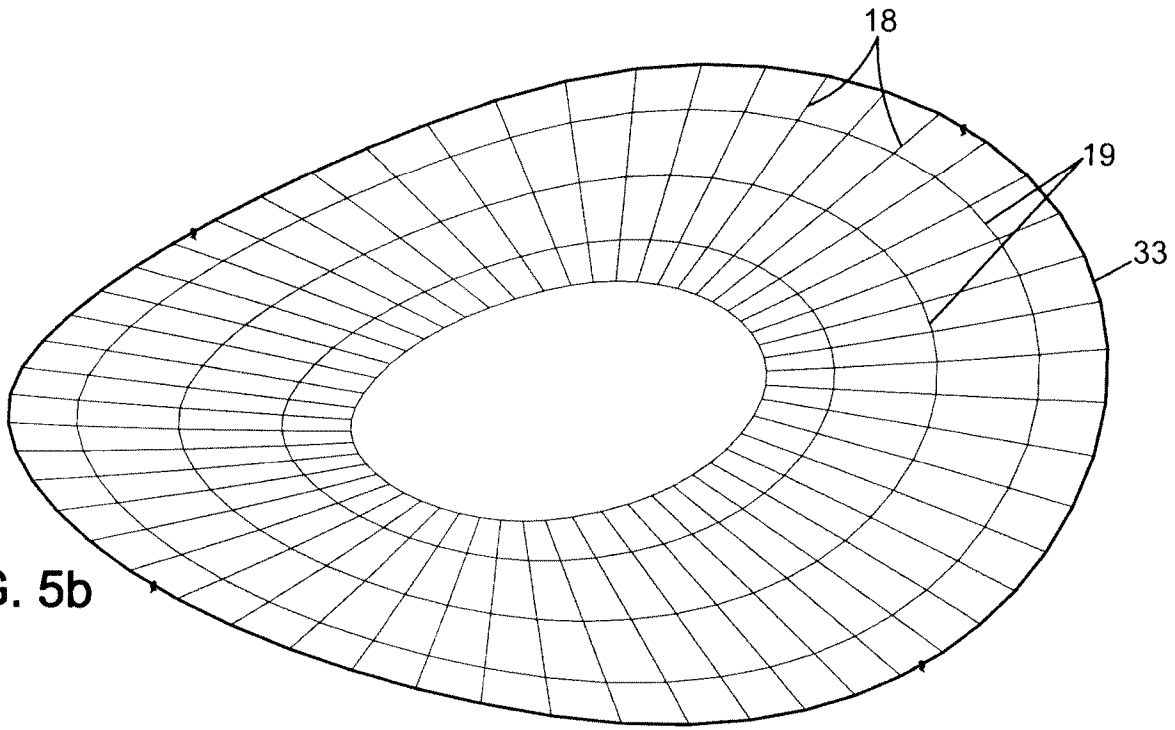

Other features and advantages of the invention will become apparent from reading the following description of a few non-limiting exemplary embodiments with references to the attached drawings, in which:

FIG. 1 is a diagram of an example of an enclosing structure in the form of a stadium;

FIG. 1*a* is a diagram of a portion of the stadium in FIG. 1 showing a cross-sectional view of the stadium in the vicinity of the roof;

FIGS. 2 and 3 are diagrams of a portion of the stadium in FIG. 1, respectively showing a front view and a radial cross-sectional view of the stadium;

FIGS. 4*a* and 4*b* are diagrams respectively showing a cross-sectional view and a top view of a first example of a roof which can be part of an enclosing structure of the invention;

FIGS. 5*a* and 5*b* are diagrams respectively showing a cross-sectional view and a top view of a second example of a roof which can be a part of an enclosing structure of the invention.

The invention concerns an enclosing structure as defined above. This enclosure may be of any conceivable type. For example, it can be all or part of a stadium, as in the example described below. Many other examples of enclosures are also covered by the invention, however, such as an arena.

FIG. 1 shows a non-limiting example of an enclosing structure that is a sports stadium. This stadium 1 schematically consists of two main parts: the structural element 2 which constitutes the base of the stadium and a roof 3 which sits atop the structural element 2.

The structural element 2 is a backfill, meaning a volume of soil, earth, granular material such as crushed rock possibly stabilized with a hydraulic binder, artificial material such as crushed concrete, industrial waste, and/or other material. This backfill is also possibly reinforced, as will be detailed below.

The backfill 2 includes and in this manner extends to all or part of the sides 10, 100 of the stadium 1 situated under the roof 3, for example the outer vertical or subvertical face of the stadium 1, possibly with multiple flights of stairs and access ramps, the inside stands, any access tunnels, and/or other areas. Other elements may optionally be incorporated into the backfill 2, for example prefabricated archways for traffic in and out of the structure and/or other elements.

The roof 3 is any type of roof and can be of any form. Preferably it is a light roof, advantageously stretched taut with the aid of one or more networks of cables and covering all or part of the space delimited by the backfill 2, or even beyond said space. The roof 3 is advantageously self-stabilizing, meaning that is subjected primarily or even exclusively to vertical stress components. Examples of such roofs are described below.

To avoid or limit uplift phenomena for the roof described above, the invention advantageously provides for the additional use of anchoring systems to facilitate maintaining the roof 3 on the backfill 2, which will be described in more detail below. These anchoring systems are advantageously placed at multiple locations in the stadium, for example at regular intervals along the periphery.

These anchoring systems are adapted to the composition of the enclosing structure 1. In particular, they are arranged to provide effective anchoring in spite of the granular nature of the backfill 2. This distinguishes them from anchors which are only meant for maintaining a roof on a completely compact structural element, such as a structural element entirely of concrete.

A non-limiting example of an anchoring system for an enclosing structure as described above will now be described with reference to FIGS. 2 and 3.

These FIGS. 2 and 3 represent a portion of an enclosing structure such as the stadium 1 in FIG. 1, respectively viewed from the front and in a radial cross-section (the center of the stadium 1 is on the right in FIG. 3). The backfill 2 is particularly visible. The roof 3 (not represented) is located above the elements in the drawings. The different elements represented in FIGS. 2 and 3 can be found at various locations in the stadium 1, for example at regular intervals along the entire periphery of the stadium 1.

In the example illustrated in these FIGS. 2 and 3, the backfill 2 is reinforced by at least one reinforcement, and here multiple reinforcements 9, situated at least partially inside the backfill 2. This or these reinforcements 9 are advantageously connected to a facing 10 defining an outside boundary of the backfill 2, for example the outside face of the stadium 1. In addition, the backfill may possibly be compacted.

The reinforcements 9 may use any appropriate materials and/or shapes. For example, they may comprise metal reinforcements: of black or galvanized steel, welded wire mesh, ladder reinforcement and/or steel wire fabric both PVC-coated (polyvinyl chloride) and uncoated, etc. Alternatively or additionally, the reinforcements 9 may comprise geosynthetic reinforcements: reinforcing bands, for example of polyester yarn inside a polyethylene envelope, geotextile membranes which may or may not be woven, for example of polyester, polypropylene, and/or other materials, and/or geogrids in the form of perforated and stretched polyethylene sheets, interwoven strips, etc.

The facing 10 is advantageously an assembly of elements. These elements can be of varying hardness. They may be panels of various shapes (hexagonal, X, T, etc.). At least some of these elements may consist of concrete panels. Alternatively or additionally, some or all of the facing elements may comprise: elements that can be reshaped, bent welded wire mesh, for example of black or galvanized steel and/or gabions intended to be filled with stone, etc.

The attachments which fasten the reinforcements 9 to the facing 10 may also be of various types and forms.

Any of the techniques proposed by the Terre Armée® or Reinforced Earth® company or any similar or equivalent technique can be used for the backfill, the reinforcements, the facing, and/or the attachments.

In the example illustrated, the roof is placed on a capping beam 11 atop the backfill 2. In one example, this capping beam 11 covers the backfill 2 along the entire periphery of the stage. It is of precast concrete or of steel for example. It advantageously consists of a succession of adjacent segments.

As will be described below in more detail, the roof may additionally comprise one or more tightly stretched sheets on a peripheral compression ring. Such a compression ring 12 is represented in FIGS. 2 and 3. In this example, it rests on the capping beam 11 and follows substantially the same trajectory (the entire periphery of the stadium). In a variant, the compression ring 12 could rest directly on the backfill 2.

The compression ring 12 may possibly be formed on site, for example by pouring reinforced concrete. Additionally or alternatively, it may be composed of precast segments, for example of reinforced concrete, prestressed concrete, fiber reinforced concrete, steel and/or composites.

The compression ring 12 can be arranged to deform radially, meaning to compress or expand locally or generally, for example in response to external stresses. This results in relative displacement between the compression ring 12 and the capping beam 11. To allow and accommodate this relative displacement, a mobile connecting means 13 can be placed between the compression ring 12 and the capping beam 11 (or between the compression ring 12 and the backfill 2 if they are in direct contact with each other). This limits the horizontal stresses transmitted to the capping beam 11 or to the backfill 2.

Such a connecting means 13 has, for example, a lower portion attached to the capping beam 11 and an upper portion integral to the compression ring 12. The lower portion of the connecting means 13 advantageously comprises a housing for a protrusion from the lower portion of the connecting means 13. The housing and the protrusion are, for example, complementary in shape (for example a slot and a straight bar) so that the two parts of the mobile connecting means 13 can slide relative to each other. Many other mobile connecting means and/or other methods for accommodating the relative movement between the compression ring 12 and the capping beam 11 (or the backfill 2) can be considered, as will be apparent to a person skilled in the art.

Advantageously, the capping beam 11 and/or the compression ring 12 can be weighted inside and/or at the top by any appropriate means. For example, such weight may comprise liquid and/or one or more solid elements. It may assume any conceivable form. The downward force exerted on the backfill 2 by this weight is added to the weight of the roof and thus establishes or reinforces the uplift resistance of the roof. This measure can supplement the uplift resistance produced by the possible use of anchoring systems connecting the roof and the backfill which will now be described.

The anchoring system 4 illustrated in FIGS. 2 and 3 comprises an anchoring element 6 and at least one tie 5 connecting the anchoring element 6 and the roof 3 through the backfill 2.

The anchoring element 6 can assume any appropriate form and have any conceivable composition. In the example illustrated, it comprises an anchor plate which advantageously offers a significant contact surface area with the backfill 2. It can be made on location, for example by pouring reinforced concrete, or be prefabricated, for example of prestressed concrete, fiber reinforced concrete, steel, and/or composites.

In the example in FIGS. 2 and 3, the anchoring element 6 is positioned inside a lower portion of the backfill 2. In other words, it is not on the surface of the backfill or in the immediate proximity of the surface, but is instead placed in the bottom half of the backfill 2. Advantageously, the anchoring element 6 may be vertically positioned within the first third of the backfill 2 (starting from the bottom of the backfill). Advantageously, the anchoring element 6 may even be situated in the first quarter of the backfill 2 (starting from the bottom of the backfill).

In yet another configuration, instead of being positioned inside the backfill 2, the anchoring element 6 could be positioned immediately under a bottom face of the backfill 2, where it presses against said bottom face of the backfill 2.

In all cases, the anchoring element 6 presses against a substantial mass of backfill 2, and the significant weight of the latter impedes any upward motion.

One (or more) tie(s) 5 connect the anchoring element 6 and the roof 3 through the backfill 2. In the example illustrated, the tie 5 represented is anchored at its lower end to the anchoring element 6, and at its upper end in the capping beam 11, which is connected to the roof 3 by means of the compression ring 12. Any conceivable anchoring method can be used for this purpose. Other configurations, such as directly attaching the tie 5 to the roof 3, can also be considered, as will be apparent to a person skilled in the art.

The tie 5 of the anchoring system 4 comprises, for example, at least one of the following: a steel bar such as a rebar, a cable such as a steel cable and/or textile fiber cable, a composite tie such as a pultruded carbon fiber rod, or a tie incorporating concrete, wood, and/or steel.

The tie 5 is advantageously encased in a sheath 8, to avoid direct contact between the tie 5 and the backfill 2, and thus to decrease the effects of negative friction. The sheath 8 can be of any conceivable type and/or form. For example, it can be a sheath of HDPE (high density polyethylene) or other material.

Advantageously, the tie 5 (and the sheath 8 encasing it if there is such) may consist of a plurality of segments connected to each other by means of coupling devices 7. These coupling devices can be of any conceivable type and/or form. For example, they may comprise steel clamps or other coupling means.

Advantageously, the tie 5, through the backfill 2, may be prestressed between the anchoring element 6 and the roof 3. In the example illustrated in FIGS. 2 and 3, the entire length of the tie 5 between the anchoring element 6 and the capping beam 11 is prestressed. One can anticipate the stresses exerted by the weight of the roof 3 on the portion of the backfill 2 between the anchoring element 6 and the capping beam 11. This limits differential settlement due to the installation of the roof 3.

Some examples of roofs 3 will now be described with reference to FIGS. 4*a*-4*b* and 5*a*-5*b*.

Advantageously, these roofs are relatively light. For example they comprise at least one sheet extending out from the peripheral compression ring 12 mentioned above, with the aid of at least one network of cables which includes taut spokes substantially perpendicular to the compression ring. Each sheet consists, for example, of a relatively light material such as a white silicone-coated fabric. It may be without openings and thus cover the entire stadium, or may have opening(s), for example in its center as shown in the example in FIG. 1. Other examples of roofs in the context of the invention may also be considered, as will be apparent to a person skilled in the art.

FIGS. 4*a* and 4*b* respectively show a cross-sectional view and a top view (omitting the upper sheet) of an example of a roof comprising two sheets 15 and 16 arranged in a lens shape around a compression ring 23 substantially comprised within a plane which can be horizontal for example. The compression ring 23 is circular, elliptical, or more generally annular in shape, and this can depend on the general shape of the stadium or of the enclosing structure of which it is a part.

The two sheets 15 and 16 extend out from the peripheral compression ring 23 with the aid of two networks of cables which include taut spokes 14 substantially perpendicular to the compression ring 23. In addition, they are connected to each other by means of bracings 17 substantially orthogonal to the plane containing the compression ring 23. For example, the bracings are arranged vertically between the two sheets, when the compression ring 23 is within a horizontal plane.

FIGS. 5*a* and 5*b* respectively show a cross-sectional view and top view (omitting the sheet) of another exemplary roof which comprises a single sheet 20. This extends in a substantially hyperboloid shape resembling a saddle, from a peripheral compression ring 33 adapted to the hyperboloid shape (meaning it has, for example, the shape of the intersection of a hyperboloid with a round, elliptical, or other cylinder). This is achieved with the aid of a single network of cables which includes taut spokes 18 substantially perpendicular to the compression ring 33. These spokes 18 may be connected to each other, in addition to their connection via the compression ring 33, with the aid of annular cables 19 following a path for example which runs substantially parallel to that of the compression ring 33. In a variant, the sheet 20 may have any other non-hyperboloid shape, while consisting of two opposing upper parts and two opposing lower parts as is the case in a hyperboloid shape.

The two roof examples described above are self-stabilizing, primarily or exclusively subjected to vertical stress components, as the horizontal stresses are assumed by the peripheral compression ring. In the example in FIGS. 4*a* and 4*b*, stability is also provided by the weight of the upper sheet, which is partially assumed by the lower sheet. In the example in FIGS. 5*a* and 5*b*, stability is also provided by the shape of the single sheet which comprises two inverse curves.

In the above description, it is understood that the uplift phenomenon to which the roof of the enclosing structure may be subjected, either continuously or intermittently, is greatly reduced or even eliminated by the effect of the anchoring systems. In effect, the uplifting of the roof 3 is reduced or even stopped by the strong resistance against the upward motion of each anchoring element 6 provided by the mass of backfill 2 above said anchoring element 6. This resistance is transmitted from the anchoring element 6 to the roof 3 by means of the corresponding tie 5 (and possibly via the capping beam 11 and/or the compression ring 12). Thus a force is created which is added to the weight of the roof 3 and which is able to maintain the roof in place on the backfill 2.

A method for assembling an enclosing structure such as the stadium 1 described above will now be detailed.

In this method, anchoring elements 6 are provided in a given distribution, for example along the general periphery of the stadium 1. The anchoring elements 6 may be placed directly on the ground if they are intended to be in contact with the bottom face of the backfill 2, or on an already installed layer of backfill 2 if they are to be placed inside a lower portion of the backfill 2.

In addition, segments of ties 5 and layers of backfill 2 are alternately placed atop each other. This is done in a manner so that a lower segment of each tie 5 is connected to anchoring elements 6 and an upper segment of each tie 5 extends beyond an upper portion of the backfill 2. If the ties 5 are made of a single piece, their lower and upper segments are then merged. This alternating installation is particularly simple and avoids the need for digging into the backfill to install the anchoring systems 4 later in the installation.

Then the roof 3 is installed so that is rests on the backfill 2 (possibly via the capping beam 11 and/or the compression ring 12) and is attached to the backfill 2 by means of the upper segment of each tie 5.

A method of disassembling an enclosing structure such as the stadium 1 described above will now be detailed.

In this method, the roof 3 is separated from the ties 5 connecting it to the anchoring elements 6 located, depending on the case, inside a lower portion of the backfill 2 or immediately under a bottom face of the backfill 2.

Then the roof 3 is taken down, for example by separating the sheets and/or the networks of cables that form it.

Segments of ties 5 and layers of backfill 2 are alternately extracted, which is a relatively simple operation.

Then, once the layers of backfill atop the anchoring elements 6 have been extracted, the anchoring elements are extracted.

From this description, one can see that the stadium 1 or any other enclosing structure of the invention can easily be assembled and disassembled, using the above methods or other methods. This is due in particular to the absence of anchoring in the foundation soil and to the use of reversible assemblies.

When the various elements used (the backfill and its reinforcements and facings, the roof and its sheets and cables, capping beam, compression ring, anchoring systems, etc.) are smaller in their dimensions and mass, for example because they consist of separable segments, this greatly facilitates stadium portability.

The invention claimed is:

1. A stadium or arena comprising:

a plurality of opposing faces;

a backfill; and a roof, wherein the backfill extends to and inside all or parts of the opposing faces of the stadium or arena, said opposing faces being situated under the roof, and wherein the roof rests on the backfill extending to and inside parts of the opposing faces of the stadium or arena and is anchored to it by means of anchoring systems which each comprise an anchoring element positioned inside a lower portion of the backfill or immediately under a bottom face of the backfill and at least one tie connecting the anchoring element and the roof through the backfill.

2. The stadium or arena of claim 1, wherein the backfill is reinforced by means of at least one reinforcement situated at least partially inside the backfill.

3. The stadium or arena of claim 2, wherein at least one reinforcement used to reinforce the backfill is connected to a facing defining an outside boundary for the backfill.

4. The stadium or arena of claim 1, wherein said tie, through the backfill, of each anchoring system is prestressed between the anchoring element and the roof.

5. The stadium or arena of claim 1, wherein the roof is placed on a capping beam atop the backfill.

6. The stadium or arena of claim 1, wherein the roof comprises at least one sheet extending from a peripheral compression ring with the aid of at least one network of cables which includes taut spokes substantially perpendicular to the compression ring.

7. The stadium or arena of claim 5, wherein the capping beam and/or a peripheral compression ring is weighted inside and/or at the top in a manner that creates or reinforces the uplift resistance of the roof.

8. The stadium or arena of claim 6, wherein the peripheral compression ring is arranged to deform radially and wherein a mobile connector is placed between the peripheral compression ring and the backfill to allow a relative displacement to accommodate such radial deformation.

9. The stadium or arena of claim 6, wherein the roof comprises two sheets arranged in the shape of a lens, and the two sheets are connected to each other by means of bracings substantially orthogonal to a plane containing the peripheral compression ring.

10. The stadium or arena of claim 6, wherein said sheet extends in a shape substantially consisting of two upper opposing parts and two lower opposing parts, such as a hyperboloid shape, from a peripheral compression ring adapted to said shape, with the aid of a single network of cables which includes taut spokes substantially perpendicular to the peripheral compression ring.

11. A method for assembling a stadium or arena, said stadium or arena comprising a plurality of opposing faces, a backfill and a roof, the backfill extending to and inside all or parts of the opposing faces of the stadium or arena, said opposing faces being situated under the roof, said roof resting on and being attached to the backfill extending to and inside parts of the opposing faces of the stadium or arena, the method comprising:

providing anchoring elements;

superimposing segments of ties alternating with layers of backfill, such that a lower segment of each tie is connected to an anchoring element positioned inside a lower portion of the backfill or immediately under a bottom face of the backfill, and an upper segment of each tie extends beyond an upper portion of the backfill;

installing a roof such that said roof rests on the backfill and is attached to the backfill by means of the upper segment of each tie.

12. A method for disassembling a stadium or arena, said stadium or arena comprising a plurality of opposing faces, a backfill and a roof, the backfill extending to and inside all or parts of the opposing faces of the stadium or arena, said opposing faces being situated under the roof, said roof resting on and being attached to the backfill extending to and inside parts of the opposing faces of the stadium or arena, wherein the disassembly method comprises:

separating the roof from ties connecting it to anchoring elements positioned inside a lower portion of the backfill or immediately under a bottom face of the backfill;

taking down the roof;

extracting segments of said ties alternating with layers of backfill;

extracting the anchoring elements.

13. The stadium or arena of claim 1, wherein the tie comprises a plurality of segments connected to each other by means of coupling devices.

14. The stadium or arena of claim 1, wherein the tie is encased in a sheath to prevent direct contact between said tie and the backfill.

15. An enclosing structure comprising:

a backfill; and a roof, wherein the roof rests on the backfill and is anchored to it by means of anchoring systems arranged within the backfill, wherein the roof comprises at least one sheet extending from a peripheral compression ring with the aid of at least one network of cables which includes taut spokes substantially perpendicular to the compression ring, and wherein the peripheral compression ring is arranged to deform radially and wherein a mobile connector is placed between the peripheral compression ring and the backfill to allow a relative displacement to accommodate such radial deformation.

* * * * *